US012247780B2

(12) United States Patent
Briggs

(10) Patent No.: US 12,247,780 B2
(45) Date of Patent: Mar. 11, 2025

(54) CONTAINER COVER

(71) Applicant: Jon Briggs, Pierre, SD (US)

(72) Inventor: Jon Briggs, Pierre, SD (US)

( * ) Notice: Subject to any disclaimer, the term of this patent is extended or adjusted under 35 U.S.C. 154(b) by 143 days.

(21) Appl. No.: 17/828,246

(22) Filed: May 31, 2022

(65) Prior Publication Data

US 2023/0009979 A1 Jan. 12, 2023

Related U.S. Application Data

(60) Provisional application No. 63/218,981, filed on Jul. 7, 2021.

(51) Int. Cl.
*F25D 3/08* (2006.01)

(52) U.S. Cl.
CPC ..... *F25D 3/08* (2013.01); *F25D 2303/0821* (2013.01); *F25D 2303/0841* (2013.01); *F25D 2331/803* (2013.01)

(58) Field of Classification Search
CPC ..... F25D 2331/803; F25D 2303/0841; F25D 3/08; F25D 2303/0821; B65D 81/3876
See application file for complete search history.

(56) References Cited

U.S. PATENT DOCUMENTS 4,338,795 A * 7/1982 House, Jr. ..... F25D 3/08 62/372
4,549,410 A * 10/1985 Russell ..... A45C 11/20 62/457.8
4,798,063 A * 1/1989 Rimmer ..... F25D 3/08 62/457.4
2005/0183446 A1* 8/2005 Fuchs ..... A45C 11/20 62/530
2010/0139310 A1* 6/2010 Poterek ..... F25D 31/007 62/457.4
2017/0238764 A1* 8/2017 Cardinal-Marchand ..... B65D 81/3886

* cited by examiner

*Primary Examiner* — Cassey D Bauer
(74) *Attorney, Agent, or Firm* — Brennan, Manna & Diamond, LLC

(57) ABSTRACT

The present invention relates to a flexible, collapsible and insulating container cover for enclosing a container that maintains the temperature of the contents of the container. The cover has a closure mechanism positioned near its top opening, so that the same can be opened for inserting the container. At least one pocket is also positioned on the cover, either on a front surface or near a bottom surface of the cover, for receiving and storing a temperature-conforming pack for maintaining a temperature of the contents of the container.

20 Claims, 5 Drawing Sheets

CONTAINER COVER

CROSS-REFERENCE TO RELATED APPLICATION

The present application claims priority to, and the benefit of, U.S. Provisional Application No. 63/218,981, which was filed on Jul. 7, 2021 and is incorporated herein by reference in its entirety.

FIELD OF THE INVENTION

The present invention relates generally to the field of insulated beverage carriers. More specifically, the present invention relates to a portable beverage carrier capable of holding the chilled or cold canned or bottled beverage and maintaining an appropriate temperature while outdoors or at social events. The canned or bottled beverage cooler comprises of a covering having one or more openings to insert the can, bottle or other container inside the covering, and includes a zipper or other closure to secure the can, bottle or other carrier inside the covering. The beverage carrier cooler features one or more built-in pockets on its side surface or at its bottom to receive an icepack or cooling pack for maintaining the temperature of cold beverages, drinks, medicines, baby formula or other material which may require a constant or controlled temperature. Accordingly, this disclosure makes specific reference thereto the present invention. Nonetheless, it is to be appreciated that aspects of the present invention are also equally applicable to other like applications, devices and methods of manufacture.

BACKGROUND

By way of background, canned or bottled beverages or other materials are often carried while going outdoors such as on picnics, camping and more. People may also enjoy beverages in a bottle or a can at social events like tailgates, birthday parties and other gatherings. The cold canned and/or bottled beverages such as soda, beer, water, soft drinks and other items such as infant formula or medicine, are enjoyed or used by people only when these beverages or other items are chilled or maintained at the proper temperature for consumption. People may not enjoy the drink in case the drink gets warm or has been watered down due to ingress of melt water from ice.

People may use a variety of devices to maintain the temperature of cold beverages while going outdoors or attending social events. For example, people may carry a portable ice chest, cooler or ice box that is an insulated container and hence keeps the food, beverages or other materials cool or at an appropriate temperature. However, the conventional ice box or coolers are usually large and bulky, and people may be reluctant in carrying the ice box or cooler while going outdoors, such as while hiking. Further, the ice box or cooler generally is large enough to store multiple food and drink items. However, people may not require such large boxes to store their individual items. People may look for other alternatives to keep their drinks and other materials chilled and at the appropriate temperature.

Other devices such as insulating bottle covers are also available in the market, that allow the stored beverage bottle, can or other container to maintain the temperature of the stored bottled, canned beverage or container. However, the insulation covers do not help in cooling the containers and also become less effective over time.

Therefore, there exists a long felt need in the art for a device that allows users to keep canned, bottled or other beverages chilled or at an appropriate temperature, as per the preferences of the users or of the requirements of the container or its contents. There is also a long felt need in the art for a portable beverage cooling device that can be easily carried while going outdoors, such as on picnics, holidays, while hiking or at social events such as parties and other gatherings. Additionally, there is a long felt need in the art for a canned, bottled or other container cooling device that remains effective for long period of time and helps in the cooling of beverages or maintaining an appropriate temperature of containers stored inside the device. Moreover, there is a long felt need in the art for a beverage cooler or temperature maintenance container that consistently regulates the temperature of cold beverages while going outdoors or at social events, and therefore ensures the users enjoy their drinks, beverages or other items. Further, there is a long felt need in the art for a beverage cooler or container temperature maintenance device that is lightweight and is easy to carry. Finally, there is a long felt need in the art for a beverage cooler or container temperature maintenance that allows the users to enjoy their favorite beverages or other materials without worry of the containers getting warm quickly or getting watered down from melt water from ice.

The subject matter disclosed and claimed herein, in one embodiment thereof, comprises a collapsible and flexible beverage bottle cooling cover or container temperature maintenance device. The cooling cover features a continuous top opening, a bottom surface, an insulating cover body defining a front surface and a rear surface. The front surface and the rear surface are positioned opposite from each other when a beverage bottle or other container is enclosed in the cooling cover. A zipper or other closure extends down from the top opening to about ½ the length of the cover for unfastening and fastening the cover around the container. An integrated external pocket is provided on the front surface for receiving and storing a frozen ice pack or gel pack to cool the beverage stored in the beverage bottle.

In this manner, the novel beverage cooler device of the present invention accomplishes all of the forgoing objectives, and provides a relatively effective, portable and convenient solution to maintain an appropriate temperature of the beverages while going outdoors or at social events. The beverage container device of the present invention is also user-friendly, as it ensures the user enjoys chilled and cold beverages while going for picnics, holidays, parties and more. Also, the beverage cooler device eliminates the need to carry a bulky ice chest while going outdoors and is convenient to use.

SUMMARY OF THE INVENTION

The following presents a simplified summary in order to provide a basic understanding of some aspects of the disclosed innovation. This summary is not an extensive overview, and it is not intended to identify key or critical elements or to delineate the scope thereof. Its sole purpose is to present some general concepts in a simplified form as a prelude to the more detailed description that is presented later.

The subject matter disclosed and claimed herein, in one embodiment thereof, comprises a collapsible and flexible container cover. The container cover allows users to maintain a desired level of coolness or appropriate temperature for the contents of their container such as a drink while enjoying or consuming it over a period of time. The container cover has a top opening, a bottom surface, an insulating cover body defining a front surface and a rear surface intended to extend around the circumference of the container, the front surface and the rear surface are positioned opposite to one another when a container such as a beverage bottle or can is enclosed in the container cover. The top opening defines the single opening for inserting and removing the container such as a bottle, can or other receptacle, a zipper or other fastener extending down from the top opening to about ⅓ length of the cover for unfastening and fastening the cover around the container, an integrated external pocket on the surface is provided for receiving and storing a temperature maintenance pack to cool or heat the contents stored in the container. The zipper or other closure, such as a hook and loop type fastener, has a removably-attached opener for opening a bottle or punching openings in a can or other container.

In yet another embodiment of the present invention, the pocket is insulating and the area of the surface on which the pocket overlaps or is sewn, is non-insulating, thereby allowing the temperature of the stored icepack, gel pack or heating pack to reach the stored contents of the container and maintain desired temperature of the container contents for a longer period after it has been removed from a refrigerator or other storage area of the container.

In yet another embodiment of the present invention, the container cover can have a strap permanently or removably-fastened to the cover for carrying the container enclosed in the cover.

In yet another embodiment of the present invention, the surface may also include an auxiliary pocket for storing personal items, a smartphone, cosmetic items, credit cards, identification cards and other things which may be useful for the individual.

In yet another embodiment of the present invention, the cover is made from a flexible material and has an insulating material and can be one or more from neoprene, vegan leather, scuba foam, cloth-laminated material and/or any other flexible and insulating material.

In yet another embodiment, the pocket has an opening for inserting the temperature-maintenance element and the opening has a zipper or other closure protection for sealing the pocket.

In yet another embodiment, the fastener for the cover can be a hook and loop fastener instead of the zipper.

In a further embodiment of the present invention, a multipurpose container cover is disclosed. The container cover is configured to keep the contents of a container at a preferred temperature for an extended period of time. The container cover includes a cover body having a transparent pocket for insertion of a temperature maintenance element, such as an ice pack, gel pack, heat pack or other suitable item disposed near the bottom surface. The pocket is configured to receive another temperature maintenance pack such as an ice pack, gel pack or heating pack having a logo or any other indicia. The temperature maintenance pack, when stored in the pocket, is placed on the bottom surface of the cover such that a container enclosed by the cover is placed on the temperature maintenance pack for maintaining the contents of the container at a desired temperature. Further, the logo or indicia of the ice pack is visually exposed from the outside for an aesthetic appeal.

In a further embodiment of the present invention, a container cover with an integrated pocket for receiving and storing a temperature maintenance pack for maintaining a desired temperature of a beverage is disclosed. The pocket is positioned on the cover body and has an opening for inserting a temperature maintenance pack. The temperature maintenance pack preferably has a curvature approximately matching the diameter of the container, such as a container with a diameter of 7.56" and may have a logo. The pocket has a transparent portion that allows the logo of the temperature maintenance pack to be visually exposed from outside. The pack remains secured within the pocket and maintains a container stored in the cover at a desired temperature.

In a further embodiment of the present invention, a method for maintaining a desired temperature of the contents of a container is described. The method comprises the initial step of storing a beverage container in the cover through a top opening of the cover. Then, putting a temperature maintenance pack in a pocket of the cover and finally removing the opener of the cover to open the container.

The advantage of the multipurpose container cover of the present invention is that it allows users to maintain a desired temperature of their drinks such as soda, beer, water, and any other type of bottled or canned drink, as well as other contents of a container which may require the maintenance of a particular temperature such as medicine, infant formula, breast milk, nutritional beverages, supplements and others that individuals may need to carry with them. The cover is flexible, collapsible, protects the container from physical damage and provides insulating properties. The cover comes in a variety of sizes, colors and designs to fit various bottles, cans and other beverage containers. The cover may also be provided with supporting ribs that will help protect the container in the event it is dropped.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1B:
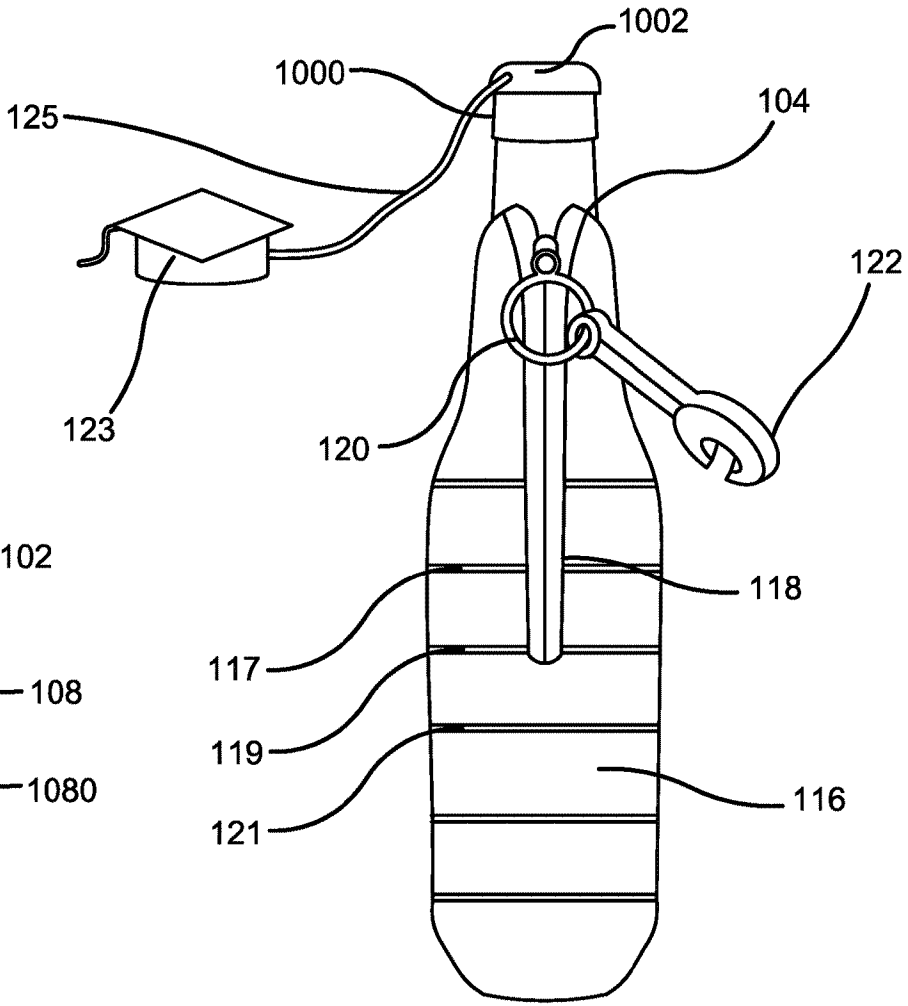
FIG. 1B illustrates a rear perspective view of one potential embodiment of the container cover in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for a device that allows users to keep containers, canned or bottled beverages chilled, cold or at the desired temperatures as per the preferences of the users. There is also a long felt need in the art for a portable container temperature maintenance device that can be easily carried while going outdoors on picnics, holidays, or at social events such as parties, or as may otherwise be required by the user. Additionally, there is a long felt need in the art for containers, canned, bottled beverage temperature-maintaining device that remains effective for long period of time and helps in cooling of the contents of the containers, such as beverages stored inside the device. Moreover, there is a long felt need in the art for a container cooler that maintains the temperature of the contents of the container while outdoors, at social events or otherwise as needed by the individual, and therefore ensures the users enjoy their drinks, beverages or other contents of the container. Further, there is a long felt need in the art for a container temperature maintenance device that is lightweight and easy to carry. Finally, there is a long felt need in the art for a container temperature maintenance device that allows users to enjoy the contents of their containers or favorite beverages without worry of the contents of the container getting warm too quickly, getting watered down via ice melt or falling outside a temperature range recommended by the manufacturer of the contents of the container.

The present invention, in one exemplary embodiment, is a novel container temperature maintenance device cover with an integrated pocket for receiving and storing a temperature maintenance pack. The pack is ideally conformable to the shape of the container stored within the sleeve. The container diameter ranges from about 5 inches to about 10 inches and more preferably about 6 to 8 inches, with about 7.56 inches in diameter being preferred. The stored temperature maintenance pack is used for maintaining the desired temperature of the contents stored in a container enclosed by the cover. The pocket is positioned on the cover body and has an opening for inserting a conformable temperature maintenance pack. The conformable pack in one embodiment is frozen and has a logo. The pocket has a transparent portion that allows the logo of the conformable temperature maintenance pack to be visually exposed from outside. The conformable temperature maintenance pack remains secured within the pocket and maintains the contents of the container stored in the cover at a desired temperature. The cover has a zipper or other fastener that can be unfastened to open the cover for inserting a container such as a bottle, can or other receptacle.

It should be noted that the front surface and rear surface as described in the disclosure are positioned opposite to each other when a container, bottle or can is enclosed within the temperature maintenance container cover of the present invention. The rear surface is defined as the one having the fastening mechanism for the cover, such as the zipper or hook and loop type of fastener. The front surface is defined as the surface having a conformable temperature maintenance pack pocket.

Figure 1A:
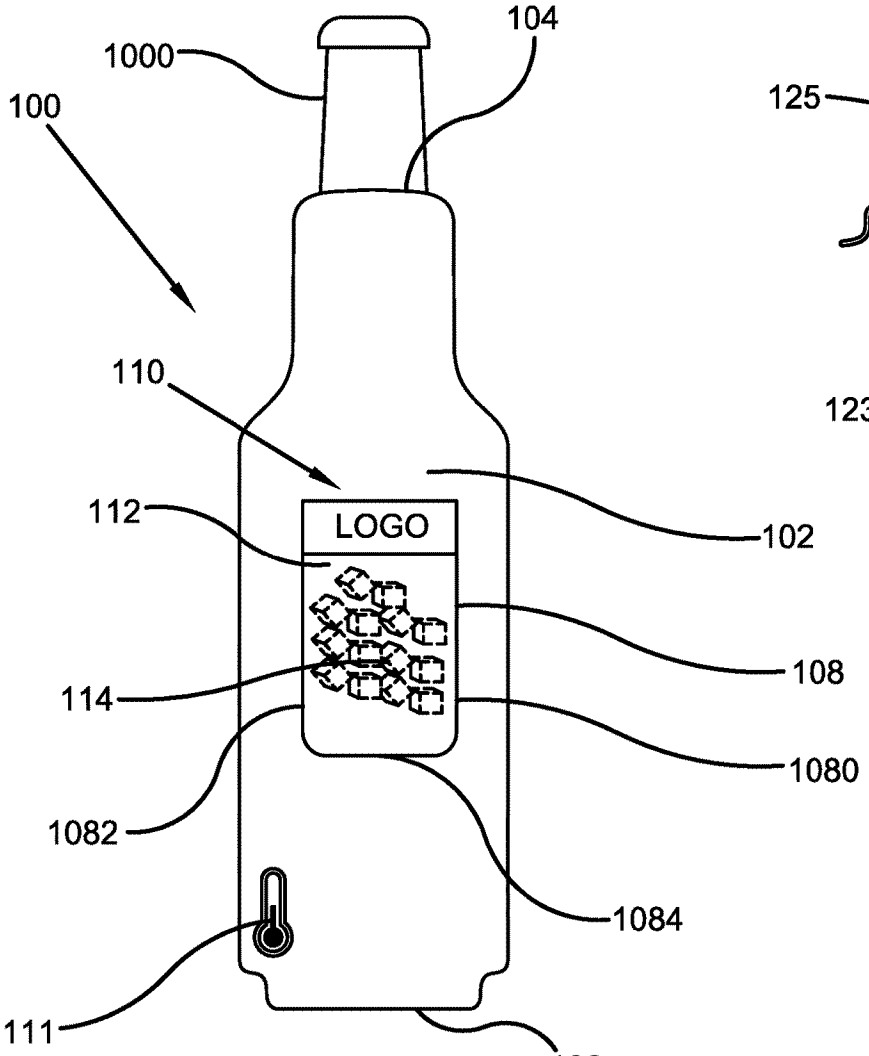
FIG. 1A illustrates a front perspective view of one potential embodiment of the container cover of the present invention in accordance with the disclosed architecture.

Referring initially to the drawings, FIG. 1A illustrates a front perspective view of a first potential embodiment of the temperature maintenance container cover of the present invention in accordance with the disclosed specification. The temperature maintenance container cover 100 of the present embodiment is designed to securely cover the container 1000 while maintaining a desired level of temperature of the contents of the container, thereby allowing a user to consume and enjoy the beverage for a longer period of time. More specifically, the cover 100 encloses the container 1000 completely while revealing the opening of the container 1000 for enabling a user to consume the contents of the container without removing the cover 100. The cover 100 may be made from an insulating material such as neoprene or vegan leather that keeps the contents of the container at a desired temperature but doesn't extend the temperature to the hands. The cover 100 is collapsible and can be folded flat for storage. The cover may also be provided with a thermometer 111 to track the temperature of the container stored within the cover.

The cover 100 has a top opening 104 from which the container 1000 extends for accessibility by a user. An opposite bottom surface 106 provides stability to the cover 100 when the cover 100 is placed on a surface while enclosing the container 1000. The top opening 104 is a continuous opening to the bottom surface 106 and is adapted for receiving the container such as a bottle 1000. The front surface 102 of the cover 100 has an integrated external pocket 108 that is used for storing a conformable temperature maintenance pack 114 to keep the contents of the container at a desired temperature for an extended time. The pocket 108 has an opening 110 through which a user can insert and store the conformable temperature maintenance pack 114. The pocket 108 is easily accessible to the user and does not get wet due to condensation of the stored pack when the pack is an ice pack. The pocket 108 can be of various sizes to accommodate conformable temperature maintenance packs of different sizes as per the preferences of the users. The pocket 108 can have a logo or any other indicia 112 for aesthetic and branding purposes.

The pocket 108 is sewn from two sides 1080, 1082 and a bottom side 1084. The pocket 108 is insulating but the area of the front surface 102 on which the pocket 108 overlaps is non-insulating, thereby allowing the coolness of the stored icepack 114 to reach the stored container and maintain the desired temperature of the contents of the container for a longer period. This mechanism of the passing through temperature to the container can be implemented in all further embodiments of the present invention.

FIG. 1B illustrates a rear perspective view of the first potential embodiment of the container cover in accordance with the disclosed description. The rear surface 116 of the cover 100 has a zipper or other fastener 118 extending down from the top opening 104 of the cover 100 to about one-third of the total height of the cover 100. The zipper 118 is configured to unfasten the cover 100 to easily insert the container 1000 in the cover 100 and then can be fastened to enclose the container such as a bottle or can 1000. The zipper or fastener 118 has a ring 120 that is used for engaging a bottle opener 122. The bottle opener 122 can be used for removing the cap 1002 of the bottle 1000. A removable cap 123 is attached to the container cover 100 via a cord 125. The cap 123 can be used to cover the opening of the container to prevent bugs or debris entering the container opening. In addition, the cover can be used to help identify the container cover and container from others and can be personalized as is needed. The cover 100 is also provided with a plurality of structural ribs 117, 119, 121 which help to provide some structure or integrity to the cover 100 as well as protection if the cover and container fall down. The structural ribs 117, 119 and 121 can be made from flexible polyurethane, rubber, polystyrene or other materials which are soft and conformable.

Figure 2:
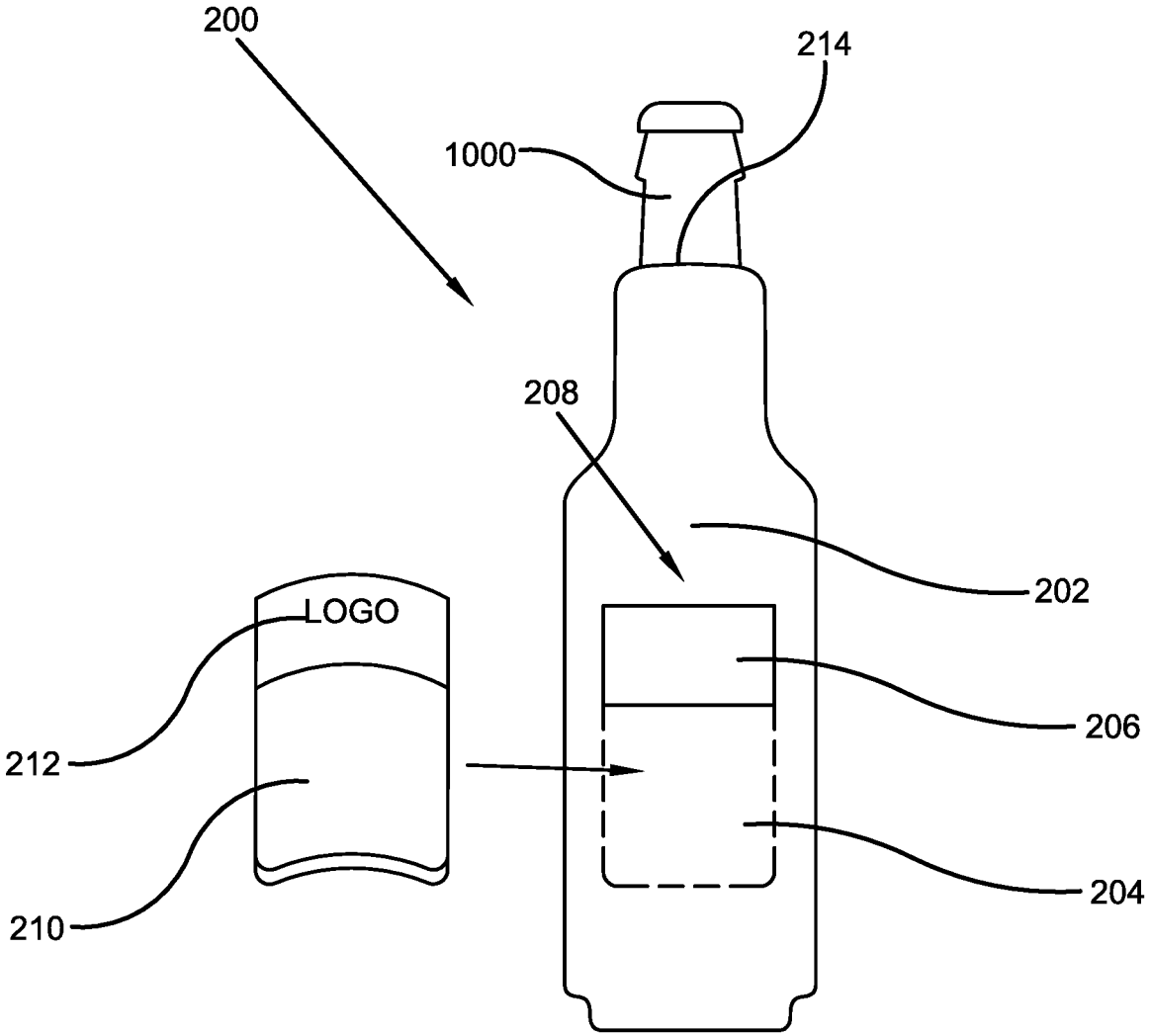
FIG. 2 illustrates a front perspective view of another potential embodiment of the container cover of the present invention in accordance with the disclosed architecture.

FIG. 2 illustrates a front perspective view of second embodiment of the container cover of the present invention in accordance with the disclosed specification. In the present embodiment, the front surface 202 of the container cover 200 has an integrated exterior pocket 204 with a transparent portion 206. The pocket 204 is used for receiving and storing a conformable temperature maintenance pack 210 for cooling or heating the contents of the container. The conformable temperature maintenance pack 210 in the present embodiment has a logo or any other indicia 212 that is inserted into the pocket 204 through the slit opening 208. When the conformable temperature maintenance pack 210 is stored in the pocket 204, the logo or indicia 212 of the ice pack 210 is covered by the transparent portion 206 allowing the logo 212 to be visually exposed from outside. The container 1000 extends from the top opening 214, thereby allowing a user to use the container 1000 without removing the cover 200.

The rear perspective view of the second potential embodiment 200 is similar to the rear perspective view of the container cover 100 of the first potential embodiment and is not described for brevity purposes.

Figure 3B:
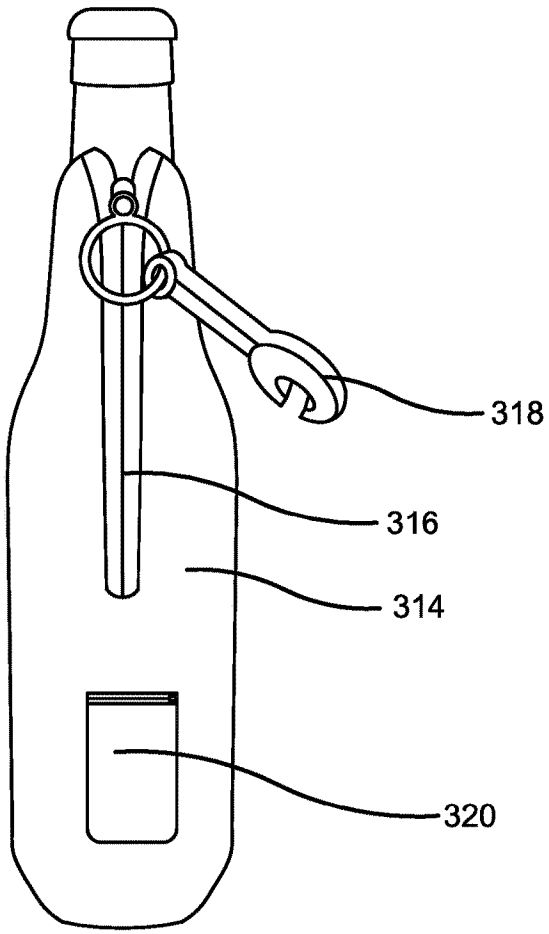
FIG. 3B illustrates a rear perspective view of another third potential embodiment of the container cover of the present invention in accordance with the disclosed architecture.
Figure 3A:
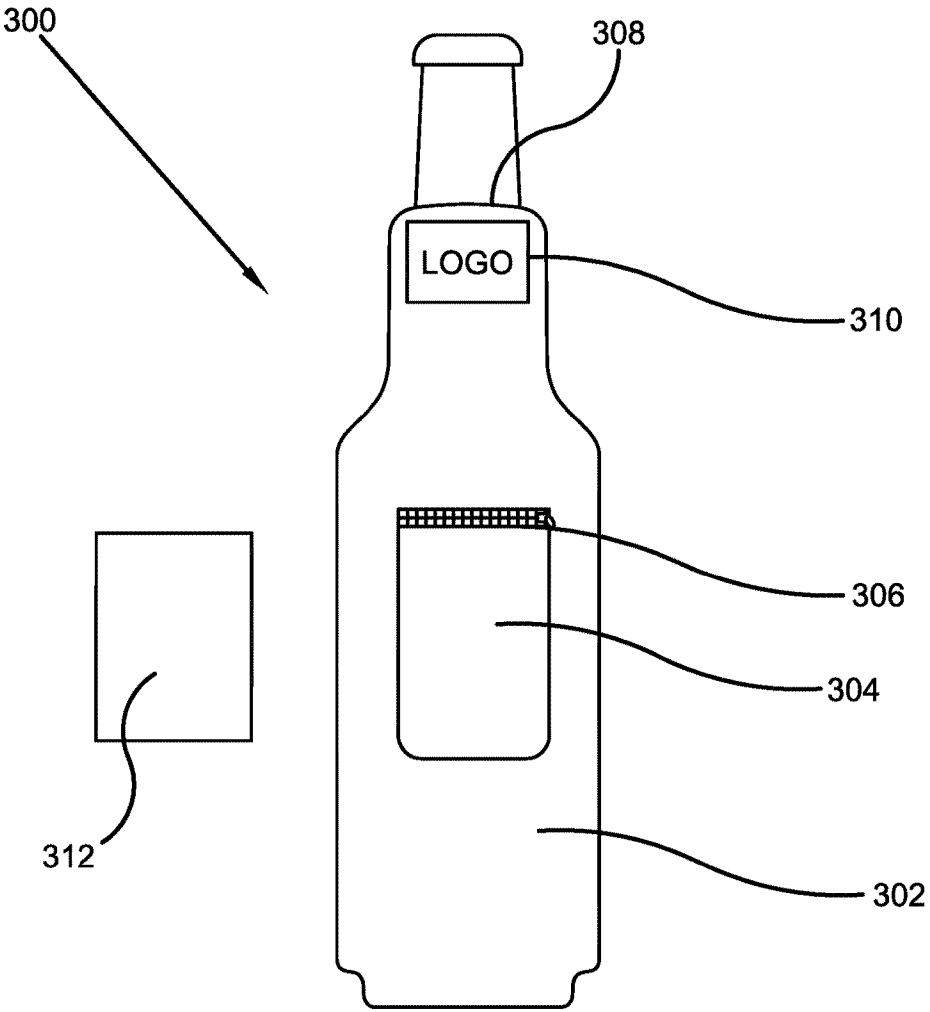
FIG. 3A illustrates a front perspective view of another potential embodiment of the container cover of the present invention in accordance with the disclosed architecture.

FIG. 3A illustrates a front perspective view of a third potential embodiment of the conformable temperature maintenance container cover of the present invention in accordance with the disclosed specification. In the present embodiment, the conformable temperature maintenance container cover 300 has a front surface 302 that has a logo or any other indicia 310 near the top opening 308. A pocket 304 is disposed on the front surface that has a zipped or other fastener opening 306. The opening 306 can be unzipped to put a conformable temperature maintenance pack 312 into the pocket 304 and then can be fastened to secure the pack 312.

FIG. 3B illustrates a rear perspective view of the third potential embodiment of the conformable temperature maintenance container cover of the present invention in accordance with the disclosed specification. The rear surface 314 of the cover 300 has a second pocket 320 for storing small personal items, cosmetic items, currency, credit cards, ID cards and others. Further similar to other embodiments, the rear surface 314 has a fastening zipper or other closure 316 having a removably-attached container opener 318. The zipper or closure 316 is used for opening the cover 300 to insert and remove the container.

Figure 4:
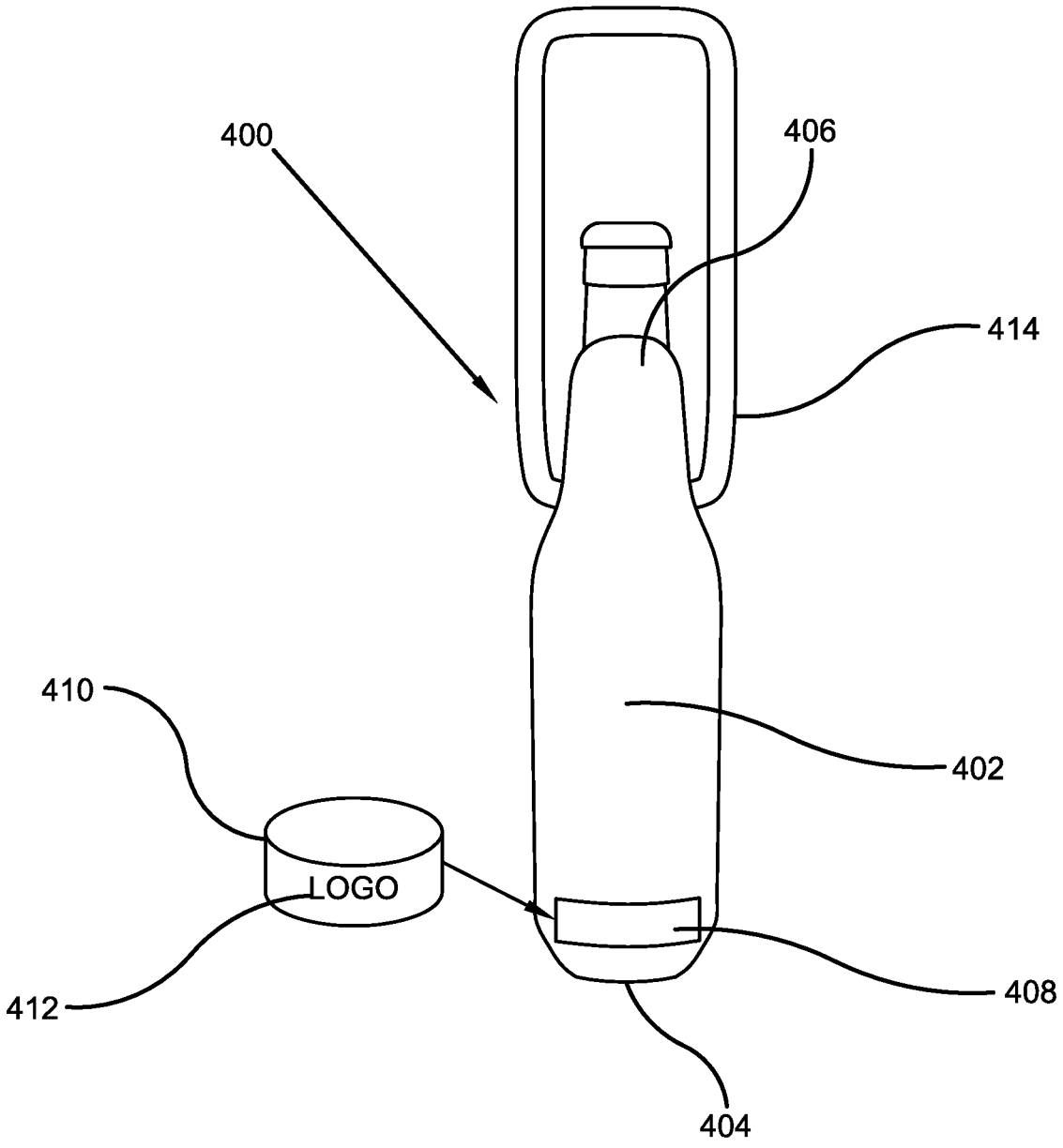
FIG. 4 illustrates a front perspective view of yet another potential embodiment of the container cover of the present invention in accordance with the disclosed architecture.

FIG. 4 illustrates a front perspective view of the fourth potential embodiment of the conformable temperature maintenance container cover of the present invention in accordance with the disclosed specification. In the present embodiment, the container cover 400 has a front surface 402 that has a transparent pocket 408 for storing the circular and conformable pack 410. The circular and the conformable pack 410 is placed in the pocket 408 such that the logo or any other indicia 412 of the conformable temperature maintenance pack 410 is visually exposed from the transparent pocket 408. The transparent pocket 408 is positioned near the base 404 of the cover 400 allowing the conformable pack 410 to be placed on the base 404. The top opening 406 is used for removing and inserting the container from the cover 400. In the present embodiment, for easy carriage of the cover 400, a strap 414 is permanently stitched to the cover 100. Alternatively, the strap 414 can be removably-attached to the cover 100 through a fastening means such as buckles or snap buttons.

Figure 5:
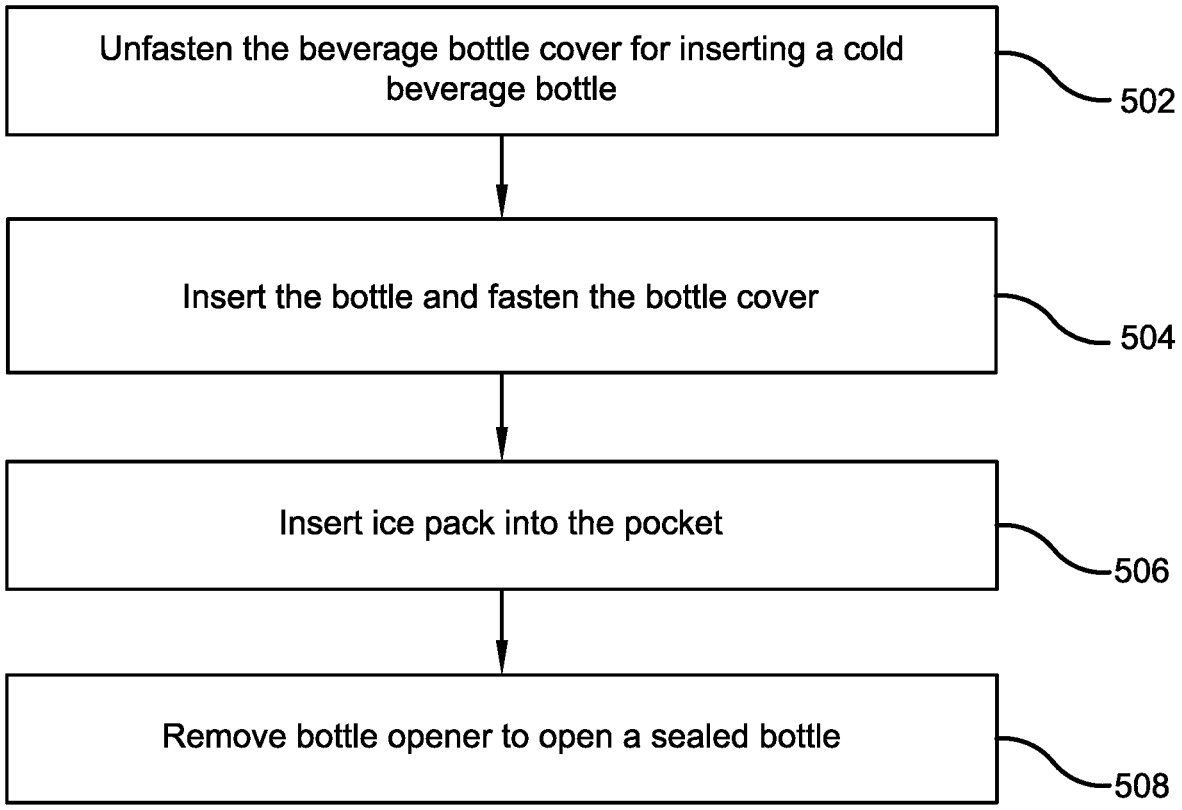
FIG. 5 illustrates a flow diagram showing exemplary steps performed to maintain the contents of a container by storing within the container cover various embodiments of the present invention in accordance with the disclosed specification.

FIG. 5 illustrates a flow diagram showing exemplary steps performed to cool a beverage by storing it within the container cover of various embodiments of the present invention in accordance with the disclosed specification. Initially, for inserting a container such as bottle or can in the cooling cover, the zipper extending from the top opening is unfastened or unzipped (Step 502). Then, the zipper is fastened to secure the container such as a bottle or can (Step 504). Thereafter, for maintaining the desired temperature of the contents of the container stored in the container, bottle, or can, a conformable pack is inserted into an integrated pocket of the cover (Step 506). Finally, the bottle opener engaged to the zipper through a ring is removed to open a sealed bottle (Step 508).

The cover 100 of various embodiments can have a thickness in the range of ⅛ inches-1 and ½ inches and fits most standard long bottles or cans. The material of the cover 100 can be scuba foam, cloth laminated material, neoprene, leather or any other flexible and insulating material. The logo or indicia can be customized and can have multiple colors and fonts.

The beverage container cover of the present invention has the advantages that its structural design is compact, has simple manufacturing and is convenient to use. The design does not hinder drinking water or any other beverage with the cover covering the bottle or can.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "beverage container cover", "beverage bottle cover", "multipurpose beverage cooling cover" and "cover", are interchangeable and refer to the beverage container cover 100,200,300,400 of the present invention.

Notwithstanding the forgoing, the beverage container cover 100, 200, 300, 400 of the present invention can be of any suitable size and configuration as is known in the art without affecting the overall concept of the invention, provided that it accomplishes the above-stated objectives. One of ordinary skill in the art will appreciate that the size, configuration and material of the beverage container cover 100, 200, 300, 400 as shown in the FIGS. are for illustrative purposes only, and that many other sizes and shapes of the beverage container cover 100,200,300,400 are well within the scope of the present disclosure. Although the dimensions of the beverage container cover 100, 200, 300, 400 are important design parameters for user convenience, the beverage container cover 100, 200, 300, 400 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A temperature maintenance cover for a container, the temperature maintenance cover comprising:

a flexible cover sized and configured to hold the container;

a closure for the flexible cover, the closure providing access to an interior of the container for inserting the container in the closure;

an insulated first pocket provided on a surface of the flexible cover, the insulated first pocket sized and configured to receive a conformable temperature maintenance pack;

a second pocket disposed at a base of the flexible cover;

a carrying strap removably attachable to the flexible cover; and wherein the insulated first pocket overlaps a portion of the flexible cover comprised of material which is less insulative than the first pocket and is configured to allow the conformable cooling pack to cool the container when held within the flexible cover.

2. The temperature maintenance cover as recited in claim 1, wherein the conformable temperature maintenance pack is one of an ice pack, a gel pack or a heating pack.

3. The temperature maintenance cover as recited in claim 1, wherein the conformable temperature maintenance pack is conformable to a diameter of the container and the container has a diameter ranging from about 5 inches to about 10 inches.

4. The temperature maintenance cover as recited in claim 3, wherein the conformable temperature maintenance pack is conformable to the diameter of the container and the diameter ranges from about 6 to 8 inches.

5. The temperature maintenance cover as recited in claim 4, wherein the conformable temperature maintenance pack is conformable to the diameter of the container and the diameter is about 7.56 inches.

6. The temperature maintenance cover as recited in claim 1 further comprising a removable cap connected to the flexible cover via a string.

7. The temperature maintenance cover as recited in claim 1 further comprising a container opener connected to the flexible cover.

8. The temperature maintenance cover as recited in claim 1, wherein the first pocket comprises a transparent portion.

9. The temperature maintenance cover as recited in claim 8, wherein the conformable temperature maintenance pack comprises a logo visible through the transparent portion.

10. The temperature maintenance cover as recited in claim 1, wherein the closure is one of a zipper or a hook and loop fastener.

11. The temperature maintenance cover as recited in claim 1, wherein the flexible cover comprises a plurality of structural supporting ribs.

12. The temperature maintenance cover as recited in claim 11, wherein the plurality of structural supporting ribs are comprised of a flexible polyurethane, rubber or polystyrene.

13. A portable beverage cooling cover comprising:

a cover sized and configured to receive a beverage container and comprised of an insulating material;

a zipper opening for the cover;

an insulated first pocket positioned along the cover and comprising a transparent portion;

a conformable cooling pack sized to fit within the insulated first pocket and comprising a logo, wherein the logo is visible through the transparent portion;

a bottle opener attached to the cover via an attachment ring;

a carrying strap removably attachable to the flexible cover; and wherein the insulated first pocket overlaps a portion of the cover comprised of material which is less insulative than the first pocket and is configured to allow the conformable cooling pack to cool the beverage container when held within the cover.

14. The portable beverage cooling cover as recited in claim 13 further comprising a removable cap.

15. The portable beverage cooling cover as recited in claim 13 further comprising a thermometer.

16. The portable beverage cooling cover as recited in claim 13, wherein the conformable cooling pack is conformable to a diameter of the beverage container and the diameter ranges from about 6 to 8 inches.

17. The portable beverage cooling cover as recited in claim 13, wherein the cover comprises a plurality of structural support ribs comprised of a select one of a flexible polyurethane, a rubber and a polystyrene.

18. The portable beverage cooling cover as recited in claim 13 further comprising a second pocket disposed at a base of the cover, and further wherein the first pocket is disposed in a surface of the cover.

19. A cooling cover for a container, the cooler cover comprising:

a cover having an insulated first pocket disposed within a front surface of the cover and a second pocket comprised of material which is less insulative than the first pocket disposed within a rear surface of the cover;

a conformable temperature maintenance pack, wherein the insulated first pocket is sized and configured to receive the conformable temperature maintenance pack;

a transparent portion positioned along a surface of the insulated first pocket;

a zippered closure disposed on the cover for opening and closing the cover around the container;

an opener connected to the zippered closure via an attachment ring;

a carrying strap removably attachable to the flexible cover; and wherein the insulated first pocket overlaps a portion of the cover comprised of material which is less insulative than the first pocket and is configured to allow the conformable cooling pack to cool the container when held within the cover.

20. The cooling cover for a container as recited in claim 19 further comprising a removable cap, a thermometer, and a plurality of structural supporting ribs.

* * * * *